US005514316A

United States Patent [19]

Kosugi et al.

[11] Patent Number: 5,514,316

[45] Date of Patent: May 7, 1996

[54] SLIP CASTING METHOD FOR MANUFACTURING CERAMIC ARTICLES

[75] Inventors: Tatsuhiro Kosugi; Mitsuru Saka; Akio Matsumoto, all of Kitakyushu; Minoru Inoue, Nakama; Toshiaki Nogami, Munakata; Takazi Naotsuka, Kitakyushu; Masao Yamasaki, Yokohama; Hiroyuki Suzuki, Fukuoka, all of Japan

[73] Assignee: Toto Ltd., Kitakyushu, Japan

[21] Appl. No.: 68,701

[22] Filed: May 28, 1993

[30] Foreign Application Priority Data

May 29, 1992 [JP] Japan ..... 4-139101

[51] Int. Cl.[6] ..... B28B 1/26

[52] U.S. Cl. ..... 264/86; 264/87; 264/256; 264/333

[58] Field of Search ..... 264/86, 87, 256, 264/333

[56] References Cited

U.S. PATENT DOCUMENTS

| | | | |
|---|---|---|---|
| 3,218,376 | 11/1965 | Schindler, Jr. et al. | 264/313 |
| 3,431,332 | 3/1969 | Cummings | 264/86 |
| 3,461,194 | 8/1969 | Alexander | 264/86 |
| 3,533,812 | 10/1970 | Cummings et al. | 264/386 X |
| 4,316,864 | 2/1982 | Bramwell | 264/86 |
| 4,396,445 | 8/1983 | Sasaki et al. . | |
| 4,902,459 | 2/1990 | Matsubara et al. . | |
| 4,948,087 | 8/1990 | Hisaeda et al. | 264/86 X |
| 4,976,903 | 12/1990 | Matsuhisa et al. | 264/86 |
| 5,013,500 | 5/1991 | Hamanaka et al. | 264/333 X |
| 5,156,855 | 10/1992 | Hisatomi et al. | 264/86 X |

FOREIGN PATENT DOCUMENTS

| | | |
|---|---|---|
| 63-224903 | 9/1988 | Japan . |
| 7208862 | 1/1974 | Netherlands . |

*Primary Examiner*—Karen Aftergut

*Attorney, Agent, or Firm*—Cushman, Darby & Cushman

[57] ABSTRACT

A ceramic article such as a sanitary pottery ware is produced by slip casting using a porous composite mold. A green ceramic body of a part such as a trap of sanitary ware is separately formed in advance by, for example, slip casting. The green ceramic body is placed in the mold cavity of the porous composite mold. Then, a slip as the material of the main part of the sanitary ware is supplied into the mold cavity to form deposit integral with the green ceramic body, whereby an integral sanitary ware is obtained by slip casting.

6 Claims, 13 Drawing Sheets

SLIP CASTING METHOD FOR MANUFACTURING CERAMIC ARTICLES

BACKGROUND OF THE INVENTION

1. Field of the Invention

The present invention relates to a slip casting method for manufacturing ceramic articles including sanitary wares with traps.

2. Description of the Related Arts

Such a casting process comprises the steps of preparing a slip by dispersing particles of pottery raw materials such as clay in a solvent such as water (referred to simply as "water" hereinafter), casting the slurry into a cavity in porous molds, absorbing the water in the slurry into the porous molds to cause the slip to solidify on the inner surfaces of the molds, and separating the solidified article from the molds. The casting method can be classified into two types: a method called "solid casting" in which water is absorbed from both sides of the cast article into the porous molds, and a method known as "slip draining method" in which water is absorbed from one side of the cast article into the porous mold and any excessive slip is discharged after a predetermined wall thickness of the article has been obtained. The portion formed by the solid casting method is referred to as a solid casting portion, while the portion formed by the slip draining method is referred to as a drain casting portion. In some cases, a cast ceramic article has both solid casting and drain casting portions.

Slip casting is an excellent forming method for the manufacture of ceramic articles in that the articles of complicated configurations can be formed using relatively simple equipment. However, the configuration is undesirably limited due to the fact that the solidification of the slip proceeds substantially uniformly over the entire area of the mold surface. For instance, it is difficult to vary the thickness of the drain casting portion according to position. A solid casting portion is also required to have good balance of thickness over the entire region thereof. Otherwise, the slip in the surrounding portion will solidify before solidification of the slip in the thicknesswise central or core portion, resulting in a defect known as "cavity".

Another factor which limits the configuration of the article to be formed by slip casting is the construction of the mold. In order to realize a complicated configuration, it is necessary that the mold is composed of many core mold parts and/or split mold parts. A too complicated configuration may require that the cast article is partially deformed or broken to allow removal of the core and the split mold parts. Consequently, there is a practical limit to complexity of the mold structure for use in the slip casting process. One measure for casting a ceramic article having a complicated configuration includes the casting of plural components of the ceramic article. The various components are then bonded together using a bonding slurry. This method, however, has many limitations because the bonding itself is a laboratious task and requires a high degree of skill. In addition, more work is required to wipe off any excess bonding slurry forced out from the bonding region. Further, this method may not be applicable depending on the portion of the article, and cracking tends to increase in the proximity of the bonding region during drying and firing.

These restrictions in the configuration and complexity of available molds is a serious problem, particularly in the production of sanitary ware with a trap. In general, the trap included in sanitary wares such as toilet bowls or urinal stalls defines an air tight seal formed by ware to prevent offensive smells or gases from escaping from the sewage pipe. In order to create such a water seal, the outlet piping of the bowl or stall is bent to form a trap.

Conventionally, the main part of such a trap is formed integrally with the body of the bowl or stall and the remainder of the trap is formed separately. The two parts are then bonded together in an extra step to form to the complete trap.

The casting of ceramic article for this purpose has thus encountered restrictions with regard to the thickness and configuration of the article to be cast. It has been impossible to form a ceramic article which does not meet such restriction.

For instance, the design of the trap of a sanitary ware has been largely limited by the configuration of the body of the bowl or stall, because the major part of the trap portion is formed integrally with the body of the bowl or stall. The design of the trap is an important factor which significantly affects the water flushing function of the sanitary ware, so that the design of the sanitary ware is largely restricted by the requirement for water flushing function. Furthermore, this conventional method, which employs the step of bonding the green ceramic body formed separately, essentially requires removal of bonding slip spearing out from the joint surface and tends to allow cracking at the joint during drying and firing.

In order to obviate this problem, Japanese Patent Laid-Open No. 3-272804 discloses a method in which a green ceramic body of most part of a trap is formed separately from the green ceramic body of the bowl or urinal and both green ceramic bodies are bonded together. This method, however, requires a troublesome work for locating both green ceramic bodies correctly relative to each other. In addition, the water flushing function may be impaired by the state of the bond of both green ceramic bodies. Furthermore, bonding itself may fail according to the design of the article.

Accordingly, an object of the present invention is to provide a method of casting a ceramic article, comprising the steps of: preparing a porous casting mold defining a mold cavity; forming separately a green ceramic body; placing the green ceramic body in the mold cavity; and supplying a slip into the mold cavity to form a deposit on the surfaces of the molds, thereby forming the ceramic article composed of the green ceramic body and the deposit of the slip integrated with each other.

According to this method, restrictions on the thickness and configuration of the ceramic article to be cast is reduced to enhance the degree of freedom in the design of the ceramic article.

In another aspect of the present invention, there is provided a method of forming by casting a sanitary ware having a bowl portion and a trap communicating with the bowl portion, comprising the steps of: preparing porous casting mold defining a mold cavity; forming separately a green ceramic body of the trap; placing the green ceramic body in the mold cavity and supplying a slip into the mold cavity; to form a deposit on the surface of the mold, followed by draining, thereby forming the sanitary ware composed of the trap and the deposit of the slip integrated with each other.

This method enables simplification of the forming process and enhances the degree of freedom in the design of the ceramic article. Hitherto, it has been necessary to reconsider the design of the trap each time the design of the sanitary ware is changed, requiring a laborious work for confirming the water flushing performance. Such laborious work can be eliminated by the method of the present invention because a trap which has been tested and confirmed to have sufficient flushing performance can be applied to a variety of models of the sanitary ware products. Consequently, the period for developing a new model has been shortened remarkably.

According to the present invention, the green ceramic body placed beforehand in the mold and the deposit of the slip supplied subsequently are integrated with each other so as not to be separated from each other in the subsequent drying and firing steps. It is therefore preferable that the green ceramic body and the slip have substantially the same composition.

Preferably, the casting is carried out under atmospheric pressure by using a mold made of a self-water-absorbing function such as plaster or, alternatively, pressurizing casting may be adopted in which a pressure-resistant mold such as a resin or ceramics mold is used and water is forcibly migrated into the mold by pressure applied to the slip.

The mold suitably used in the present invention is a composite mold which is composed of a plurality of mold parts which cooperate in defining a mold cavity. The green ceramic body formed in advance has to be held still in this mold cavity. This can be done by suspending the green ceramic body in the mold cavity by using a steel wire or the like which is to be extracted after the separation of the cast article from the mold. Such a method of holding the green ceramic body, however, cannot suitably be applied to the case where the green ceramic body has a complicated construction as is the case of a trap of a sanitary ware or where the green ceramic body is large in size, due to difficulty in correctly locating the green ceramic body. The holding of the green ceramic body in the mold cavity is therefore preferably done by allowing the green ceramic body to rest on a molding surface.

The above and other objects, features and advantages of the present invention will become clear from the following description of the preferred embodiments when the same is read in conjunction with the accompanying drawings.

DESCRIPTION OF THE PREFERRED EMBODIMENTS

Figure 1:
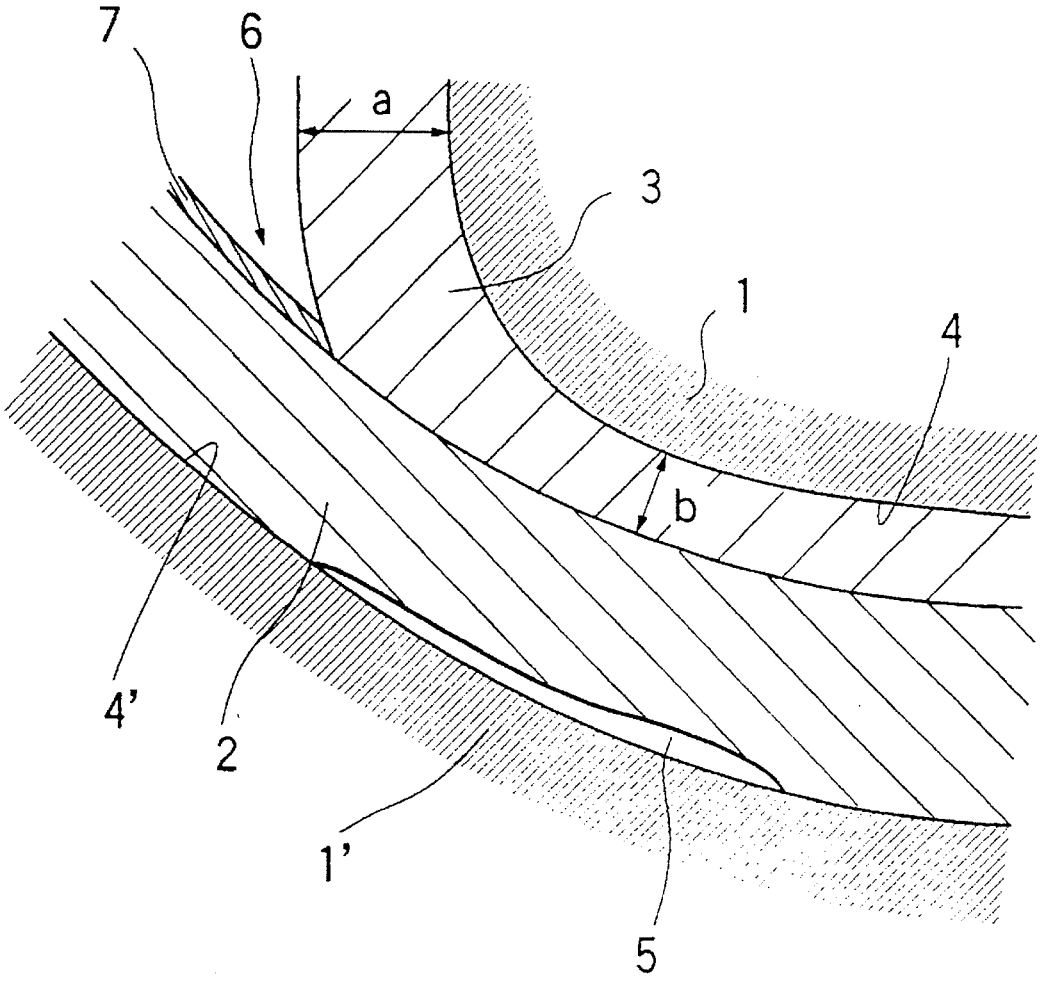
FIG. 1 is a schematic sectional view of a portion of a ceramic article illustrative of a casting method in accordance with the present invention.
Figure 2:
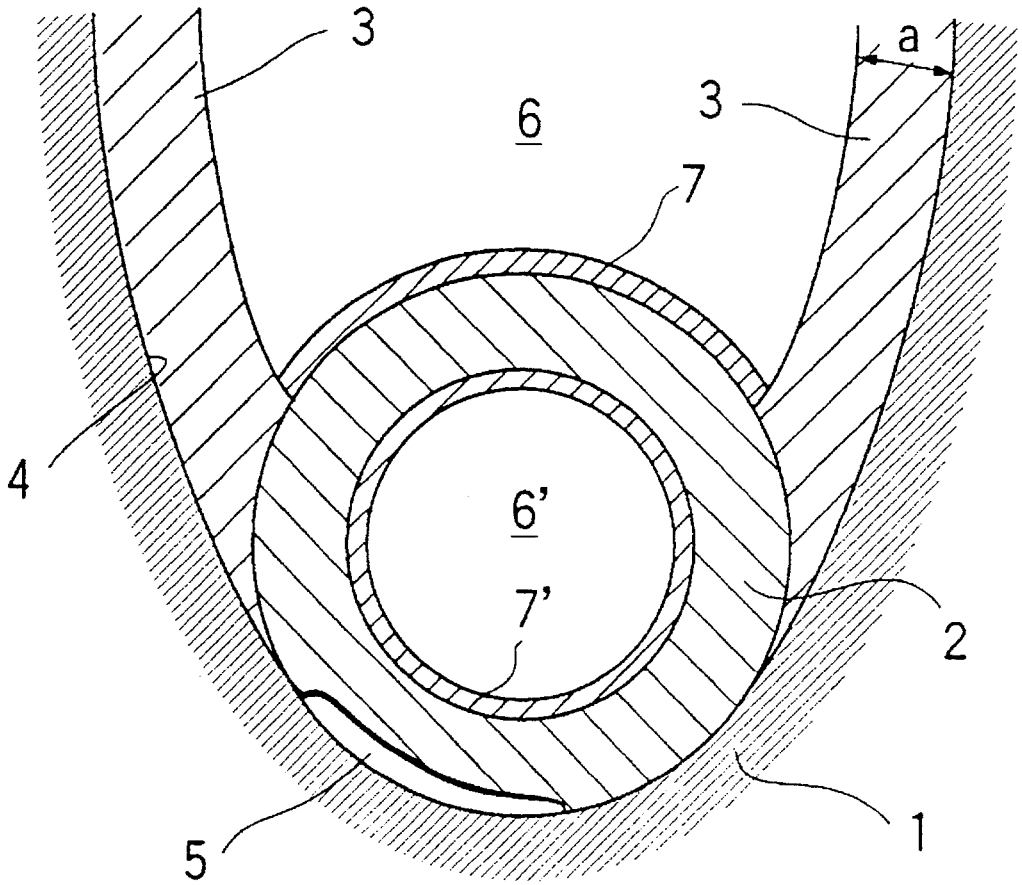
FIG. 2 is a view similar to that in FIG. 1; illustrative of another embodiment of the casting method in which a tubular green ceramic body is placed in a casting mold.

FIG. 1 illustrates a concept of the casting method in which a green ceramic body is placed on the molding surface of a casting mold part. More specifically, a casting mold has mold parts 1 and 1' respectively presenting molding surfaces 4 and 4' which cooperate with each other in defining therebetween a mold cavity. A green ceramic body 2, which has been formed in advance in conformity with the shape of the molding surface 4' of the mold part 1' is placed on an article such as sanitary ware, the cast article is shelved for a while after the drainage of the slip or air is blown into the mold, so as to reduce the water content of the cast article, i.e., to harden or set the article to some extent, before the article is separated from the mold. In the experiment, however, the water content was measured immediately after the drainage of slip, in order to attain uniformity of the measuring condition. The materials of both the green ceramic body placed in the mold and the slip supplied later were vitreous china raw material for use as the material of sanitary wares. The green ceramic body placed in the mold was formed by atmospheric-pressure casting using a plaster mold. The water content of the deposit formed from the slip supplied later was also measured and confirmed to be 25.0% in all samples of Table 1.

TABLE 1

| Water-content of green ceramic body when placed in mold (wt %) | Water content of green ceramic body including temporary deposit after deposition and slip draining (wt %) | Thickness of temporary deposit (mm) |
|---|---|---|
| 26.1 | 26.4 | 0.3 |
| 24.9 | 25.6 | 0.5 |
| 24.0 | 25.4 | 0.7 |
| 22.0 | 25.3 | 1.0 |
| 20.1 | 25.1 | 1.4 |
| 19.1 | 25.2 | 1.6 |
| 18.1 | 25.0 | 1.8 |
| 17.0 | 25.0 | 2.1 |
| 16.0 | 25.1 | 2.5 |

Figure 3:
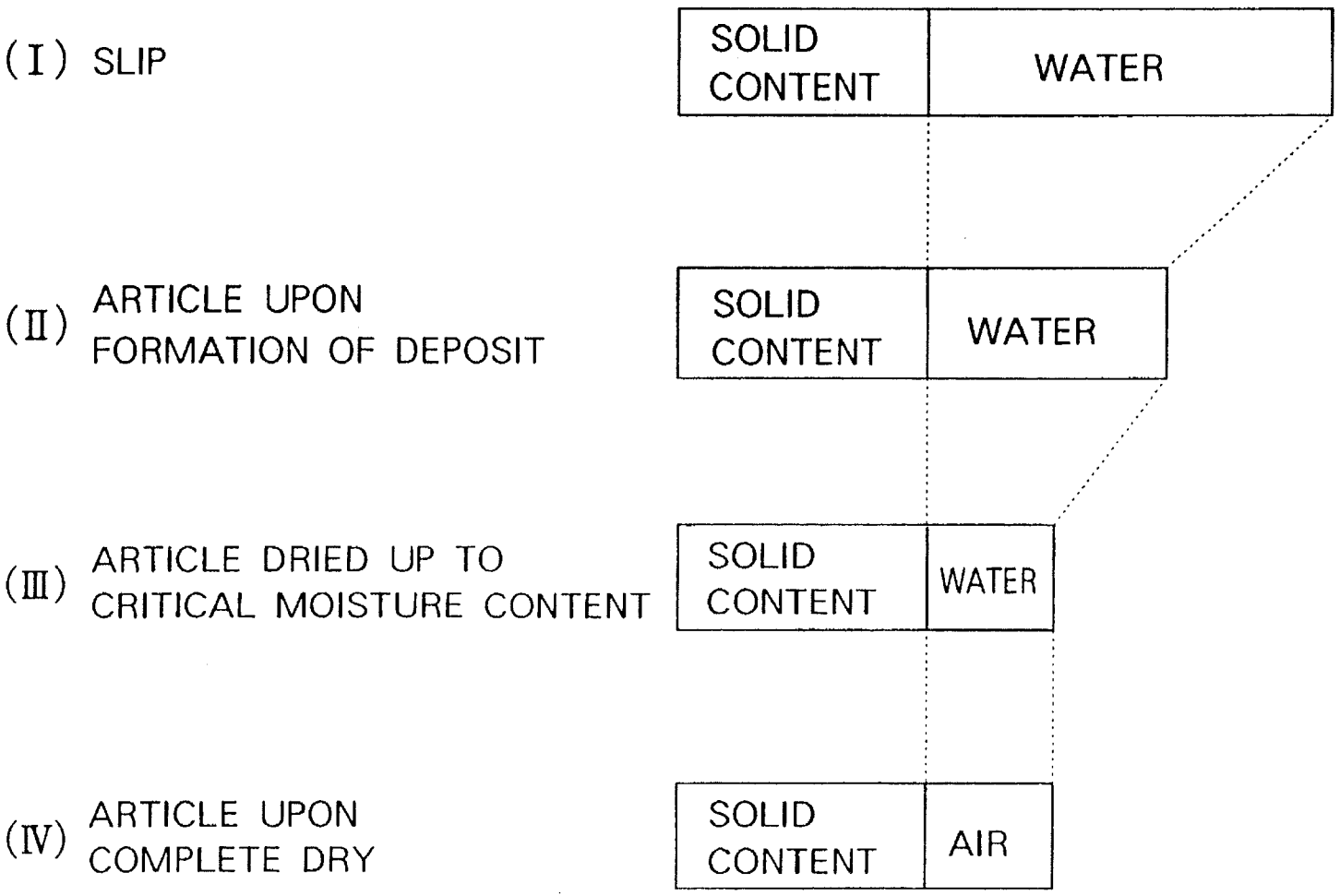
FIG. 3 is a diagrammatic representation of change in the solid content-to-water or air content in terms of volume ratio in a process in which a slip is formed into an article.

The critical moisture content of this green ceramic body was 18.0%. The concept of the critical moisture content will be understood from the following description taken in conjunction with FIG. 3 which shows the changes in the content ratio between solid matter (raw material particles) and water or air in terms of volumetric ratio, from the beginning till the completion of production of the article. More specifically, phase (I) shows the state of the slip when supplied into the mold. Water component of the slip is absorbed by the mold to form a deposit, thus providing a state shown in phase (II). Contraction by drying is started in this state and is terminated when the state shown in the phase (III) is attained. The water content in the phase (III) is the critical moisture content. Thereafter, water is substituted by air, until the completely dried product is obtained as in phase (IV).

In this green ceramic body, therefore, the water content in the phase (II) in which deposition is completed under atmospheric forming pressure in the plaster mold is 25.0%, and the critical moisture content in the phase (III) is 18.0%. These values of water contents are illustrative and vary according to the type of the green ceramic body raw material. For instance, when the green ceramic body is made of vitreous china raw material for sanitary wares, the water content under atmospheric molding pressure in the plaster mold (phase (II)) approximately range from 21% to 28%, and the critical moisture content roughly ranges from 14% to 21%.

From the view point of desirable water content of the green ceramic body placed in the mold, judging from the measurement results shown in Table 1, it is preferred that the water content of the green ceramic body including temporary deposit after completion of deposition and slip draining is made as small as possible, as well as the thickness of the temporary deposit. As will be understood from Table 1, the water content of the green ceramic body including the temporary deposit after deposition and slip draining is smaller when the water content of the green ceramic body placed in the mold is smaller. However, there is no substantial difference when the water content of the green ceramic body is below the critical moisture content. This may be attributable to the fact that the green ceramic body having water content below the critical moisture content has vacant pores which absorb the water from the slip. The greater the water content of the green ceramic body placed in the mold, the smaller the thickness of the temporary deposit. However, if the water content of the green ceramic body is increased beyond the level of the water content of the deposit from the slip, the green ceramic body placed in the mold is undesirably softened to cause a trouble when the cast article is separated from the mold.

It is therefore preferred that the water content of the green ceramic body placed in the mold is so selected as to be greater than the critical moisture content but smaller than the water content of the deposit after completion of deposition from the slip supplied later.

Another measure for averting from the trouble concerning the temporary deposit is to add a binder to the composition of the green ceramic body to be placed in the mold, so as to enhance the strength of the green ceramic body to avoid swelling of the green ceramic body.

Preferably, the binder to be added is organic type. Examples of such binder are sodium carboxylmethyl cellulose, tragacanth gum, gum arabic, polyvinylalcohol, sodium alginate, casein, cellulose acetate, dextrin, methylcellulose, peptone, soluble starch, hydroxypropyl cellulose, gelatin, various nignyn extracts and various emulsion-type binders. Preferably, the content of the binder ranges from about 0.5% to about 5% of the dry weight of the green ceramic body.

The green ceramic body which is to be placed in the mold can be formed by various methods such as slip casting, extrusion or wet-pressure forming method, although slip casting is preferably adopted when the article to be formed has a complicated form as is the case of the trap of a sanitary ware. When the green ceramic body to be placed in the mold is formed by slip casting, still another measure for averting from the problem in regard to the temporary deposition is to set the casting pressure at which the green ceramic body is cast to a level which is higher than the pressure of casting of the slip supplied later. The term "casting pressure" is used here to mean the sum of the capillary suction force exerted by the mold, the pressurizing force at which the slip is pressurized and the vacuum suction force applied to the mold.

This measure is intended to form the green ceramic body to be placed in the mold at high pressure so as to realize a high density of raw material particles of the green ceramic body, thus enhancing the strength of the green ceramic body to prevent swelling of the same.

When this measure is adopted to enhance the density of raw material particles of the green ceramic body, it is preferred that the casting pressure is determined so as to reduce the critical moisture content of the green ceramic body. The critical moisture content of a cast body is substantially constant when the casting pressure is low. However, when the casting pressure is increased beyond a certain threshold, the critical moisture content decreases in accordance with the rise in the casting pressure. The above-mentioned threshold casting pressure is generally between 10 $kgf/cm^2$ and 50 $kgf/cm^2$ as to classic ceramics such sanitary wares or dishes, made of pottery stone, clay or feldspar or the like, whereas, as to fine ceramics such as alumina, zirconia, cyalone, silicon carbide, silicon nitride or the like, the threshold casting pressure usually is equal to or below the casting pressure of plaster mold which is generally from 1 $kgf/cm^2$ to 2 $kgf/cm^2$ and which is substantially the same as the capillary suction force produced by plaster.

In some cases, however, an advantage is brought above from an industrial point of view, even when the pressure at which the green ceramic body is cast is below the threshold casting pressure at which the critical moisture content starts to change, as will be understood from the following description taken in conjunction with Table 1. Referring to Table 1, when the green ceramic body to be placed in the mold was formed by casting using a plaster mold, the water content at the time of separation of the green ceramic body from the plaster mold was 25.0%. In order to attain the water content value of 24% of the green ceramic body when the latter is placed in the mold, it is necessary that the green ceramic body taken out of the plaster mold has to be dried to reduce the water content from 25% to 24% before the green ceramic body is set in the mold. From an industrial technical point of view, it is extremely difficult to effect such a control of the drying state as to obtain an equal or constant water content on all the green ceramic bodies to be placed in the molds. On the other hand, it was confirmed that, when the green ceramic body was cast under a casting pressure of 6 $kgf/cm^2$, the water content of the green ceramic body when separated from the mold was substantially constantly regulated to 24%. Controlling the casting pressure to 6 $kgf/cm^2$ can be done without difficulty and without causing any substantial change in the critical moisture content. It is therefore possible to stably prepare green ceramic bodies having water content of 24% by adopting this casting pressure.

A further way of averting from the trouble attributable to temporary deposit is to apply a water repellent agent on the surface of the green ceramic body to be placed in the mold, thereby preventing swelling of the green ceramic body. Examples of such water repellent agent are wax, paraffin or the like, and application of such an agent can be done by dipping, spraying or brush application.

A still further way of averting from the trouble caused by temporary deposit is to set the water content of the green ceramic body to be placed in the mold to a level substantially the same as that of the slip which is to be supplied later, thereby preventing the green ceramic body from swelling. When the composition of the green ceramic body to be placed in the mold and the composition of the slip to be supplied subsequently are exactly the same, this method can be carried out such that the green ceramic body is cast from a slurry which is prepared by adding to the above-mentioned slip a flocculant and water to cause it to coagulate at low density.

A yet further measure for averting from the trouble attributable to be presence of the deposit is to form the green ceramic body to be placed in the mold with finer particles, i.e., smaller particle size, than that of the slip to be supplied later, so as to enhance the mechanical strength of the green ceramic body to prevent the latter from swelling.

This method is generally carried out more effectively by further refining fine particles among the particles of raw material of the green ceramic body, rather than by reducing the particle size over the entire range of particle size distribution. For instance, when classic ceramics such as those for sanitary wares or dishes are used, the reduction in the particle size can be realised by selecting a clay having small particle size.

Several methods have been described as measures to avoid troubles attributable to the presence of the temporary deposit. These methods were tested under the same conditions as the experiment described in connection with Table 1, and the results of the test are shown in Table 2.

In Table 2, data shown in the line headed by "comparison" are the values shown in Table 1 as obtained when the water content of the green ceramic body at the time of placement in the mold is 22.0%.

In Example I, the green ceramic body to be placed in the mold was prepared by atmospheric-pressure casting in a plaster mold, from a slip obtained by adding 0.5% (dry weight basis) of sodium carboxymethyl cellulose to the slip and stirring the mixture, the green ceramic body thus formed, having water content of 25.5% at the time of separation from the plaster mold, being dried so that a reduced water content of 22.0% was obtained when the green ceramic body was placed in the mold.

In Example II, the green ceramic body to be placed in the mold was cast under a casting pressure of 40 kgf/cm$^2$, so that the green ceramic body had water content of 22.0% when separated from the mold, and this green ceramic body with reduced water content was placed in the mold without drying. In this case, the critical moisture content of the green ceramic body was 16.8%.

Example III employed a green ceramic body having water content of 22% prepared by the same process as "Comparison". In this Example, paraffin was applied to the green ceramic body before the latter was placed in the mold.

In Example IV, 0.5% (dry weight basis) of magnesium chloride was added to the slip (water content 37.5%) for forming the green ceramic body to be placed in the mold, followed by addition of water so as to attain a water content of 60%. The green ceramic body was then formed from this slip by casting in a plaster mold under atmospheric pressure. The water content of this green ceramic body when separated from the plaster mold was 35%. This green ceramic body was placed in the mold without dehydration. The viscosity level of the slip used from which the green ceramic body was cast was measured by a Brookfield viscosity meter to be 800 cp both in "Comparison" and Example IV.

In Example V, the green ceramic body was cast under atmospheric pressure in a plaster mold from a slip having a composition containing 25 wt % of quartz, 25 wt % of feldspar and 50 wt % of clay, after replacing the clay component having mean particle size of 1μwith a clay having a mean particle size of 0.5μ. The green ceramic body thus formed has water content of 2.47% when separated from the plaster mold, and was dried to attain a reduced water content of 22% when it was placed in the mold.

TABLE 2

| Water content of green ceramic body when placed in mold (wt %) | Water content of green ceramic body including temporary deposit after deposition and slip draining (wt %) | Thickness of temporary deposit (mm) |
|---|---|---|
| Comparison 22.0 | 25.3 | 1.0 |
| I 22.0 | 23.0 | 0.3 |
| II 22.0 | 23.7 | 0.9 |
| III 22.0 | 23.9 | 0.6 |
| IV 35.0 | 29.0 | 0 |
| V 22.0 | 23.7 | 0.5 |

Thus, Examples I, II, III and V employed green ceramic bodies of the same water content as the Comparison but achieved lower water contents of green ceramic body including temporary deposit after deposition and slip draining, as well as small thickness of the temporary deposit, as compared with the values of Comparison, thus proving effectiveness of the measures employed to avoid troubles attributable to presence of the temporary deposit.

Example IV exhibits a characteristic feature in that no temporary deposit was formed although the water content is higher than that in the Comparison in the state after deposition and slip drainage. Thus, Example IV is suitably employed in such a case where cracking in temporary deposit during drying and firing has to be strictly avoided while the strength of the green ceramic body to be placed in the mold is not so critical.

Figure 4:
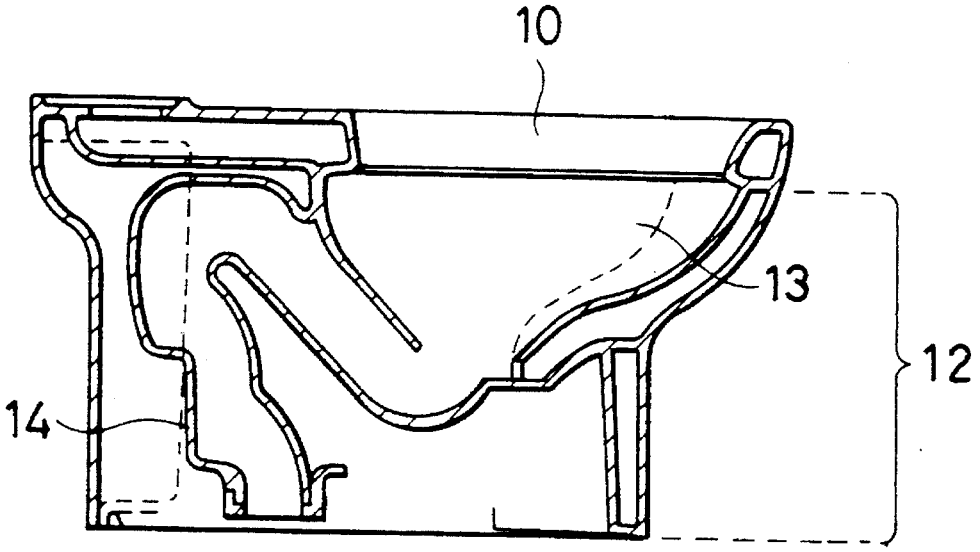
FIG. 4 is a longitudinal sectional view of a water flushing toilet bowl.
Figure 5:
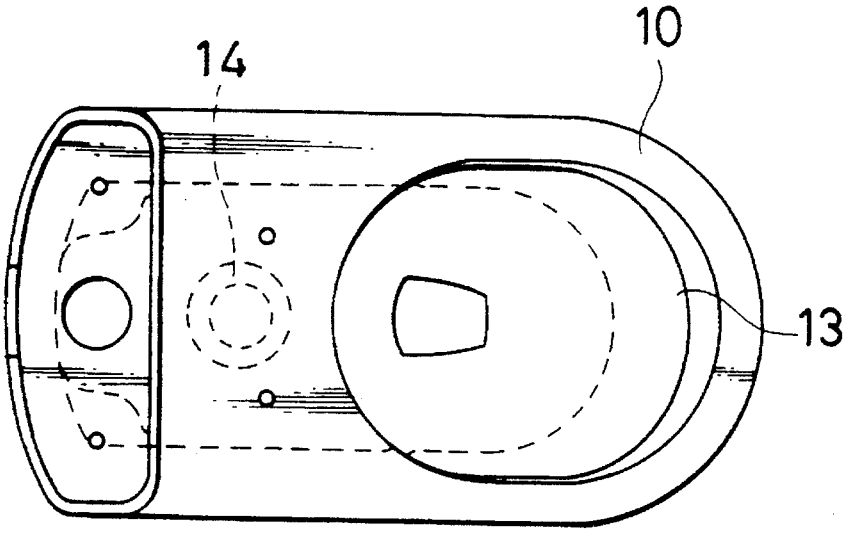
FIG. 5 is a plan view of the water flushing toilet bowl.
Figure 6:
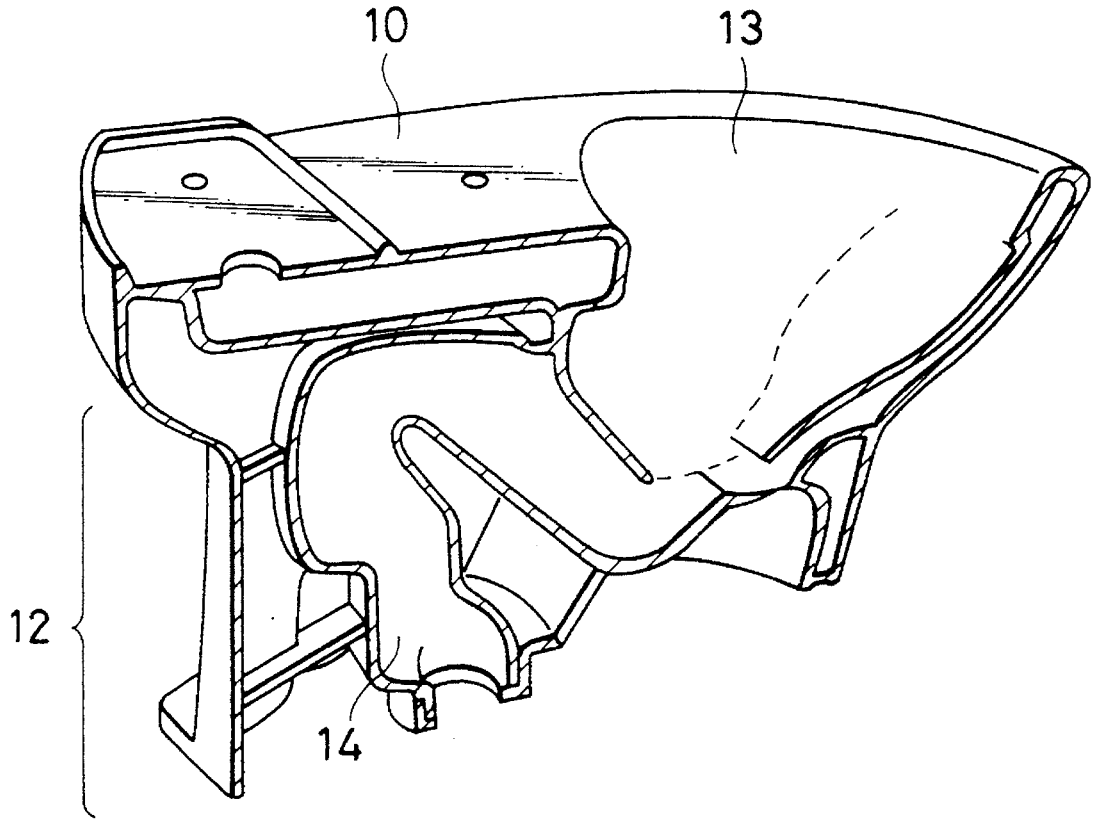
FIG. 6 is a sectional perspective view of the water flushing toilet bowl.

FIGS. 4, 5 and 6 are a vertical sectional view, a plan view and a sectional perspective view of a water flushing toilet bowl. The toilet bowl has a rim portion 10 and a barrel portion 12. These portions 10 and 12 are formed separately and then bonded together. More specifically, the barrel portion 12 includes a bowl portion 13 and a trap portion 14. The trap portion was formed by the casting method in accordance with the present invention.

Figure 7:
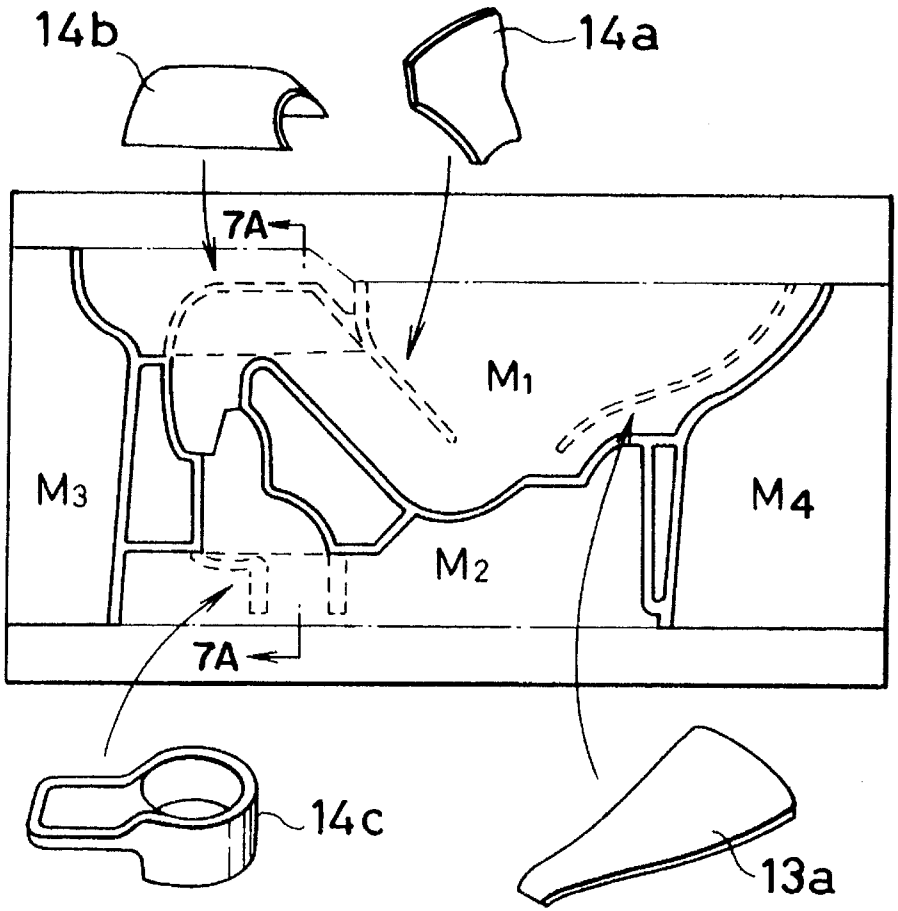
FIG. 7 (PRIOR ART)
FIG. 7 is a sectional view of a water flushing toilet bowl, illustrative of a conventional casting method, showing also a component which is to be attached to the bowl after the casting.
Figure 7A:
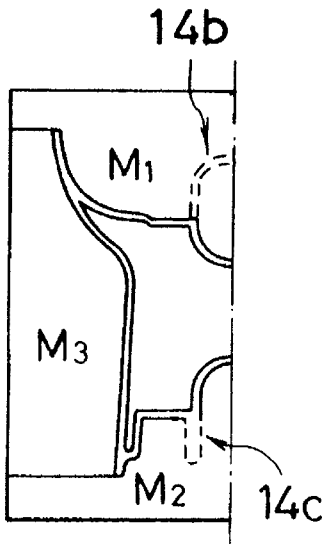
FIG. 7A is a sectional view taken along the line 7A—7A of FIG. 7.

FIGS. 7 and 7A illustrate a known method for forming the barrel portion. The barrel portion is formed in this known method by using a composite mold having four mold parts: namely, a core M1, a bottom mold part M2 and left and right side mold parts M3, M4. The main part of the barrel portion is formed integrally with the central part of the trap portion by using this composite mold. Meanwhile, components such as portions 14*a*, 14*b* forming upper part of the trap portion, a portion 14*c* which forms the lower part of the trap portion adjacent to the draining pipe, and a portion 13*a* presenting front part of the bowl were formed separately, and these components are bonded to the green ceramic body of the main part by means of a bonding slurry.

Figure 8:
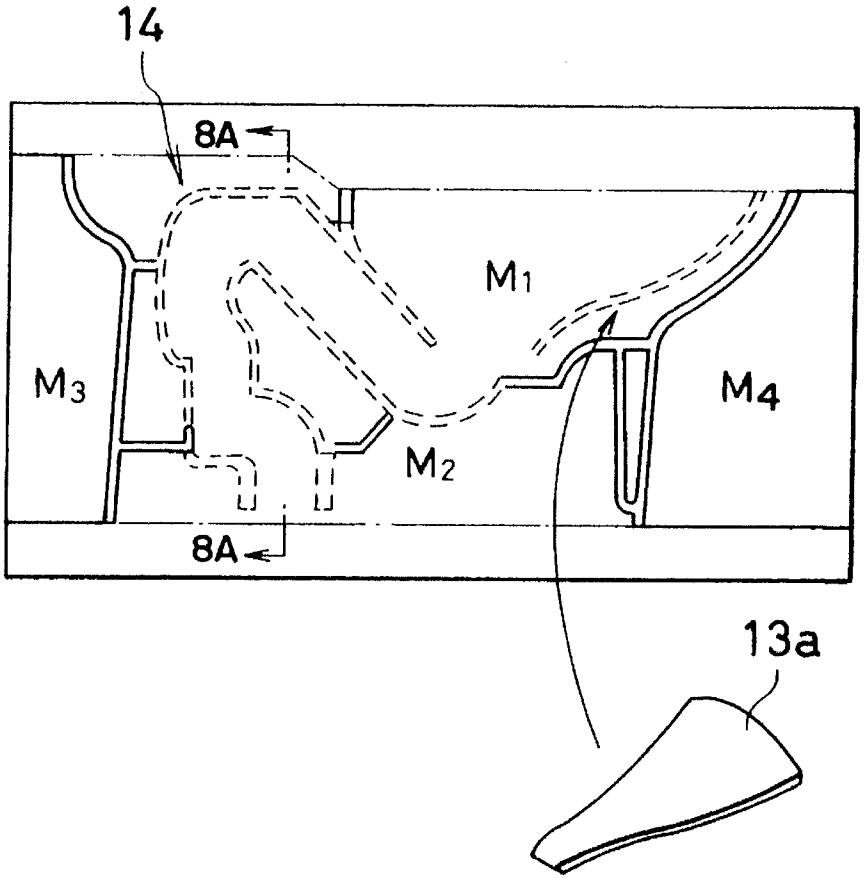
FIG. 8 is a sectional view of an article illustrative of a casting method in accordance with the present invention.
Figure 8A:
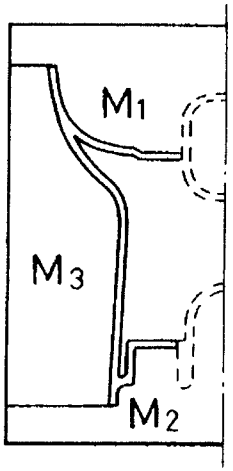
FIG. 8A is a sectional view taken along the line 8A—8A of FIG. 8.

FIGS. 8 and 8A shows how the barrel portion is formed by the method of the present invention. As in the case of the known method, the method of the invention employs a composite mold having four mold parts: namely, a core M1, a bottom mold part M2 and left and right side mold parts M3, M4. It is to be noted, however, the trap portion 14 is integrated with the main part of the toilet bowl by a procedure which is different from that of the known method. Namely, in the invention, a green ceramic body of the trap portion 14 is separately formed and placed in the composite mold, and a slip which is to form the main part of the bowl is supplied into the composite mold and allowed to solidify therein, whereby the trap portion 14 is integrated with the main part of the bowl. Then, a green ceramic body forming front part 13*a* of the bowl is bonded to the main part as in the case of the known art.

Although in the embodiment shown in FIG. 8 the whole trap portion 14 is beforehand formed, this is only illustrative and the embodiment may be such that only part of the trap, e.g., central part, is formed in advance while the remainder parts of the trap portion are then cast together with the main part of the toilet bowl.

Figure 9:
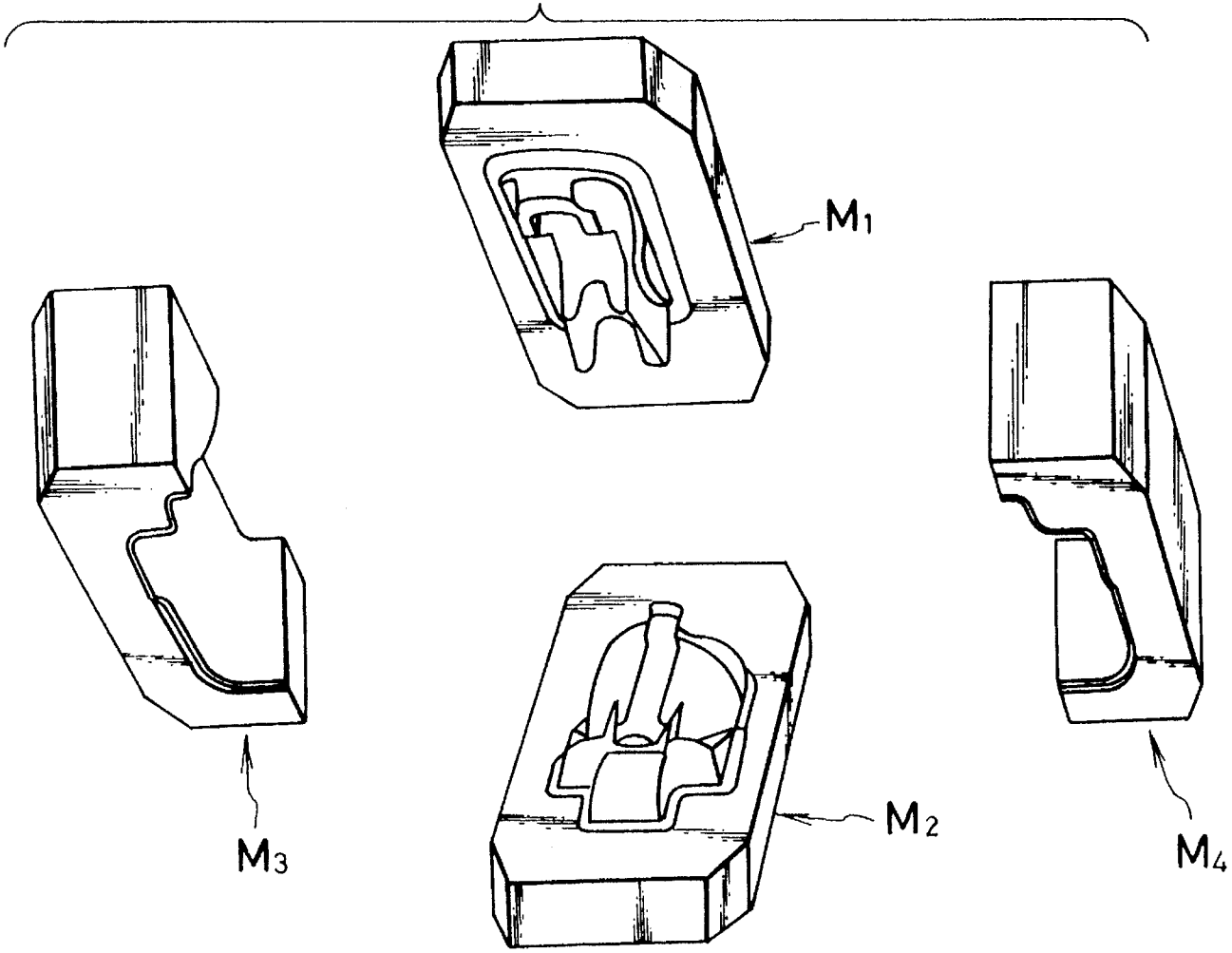
FIG. 9 is an exploded perspective view of a mold employed in the casting method shown in FIG. 8.

FIG. 9 is a perspective view of the composite mold. It will be seen that a mold cavity is defined by combining the core M1, bottom mold part M2 and left and right side mold parts M3, M4.

Figure 10:
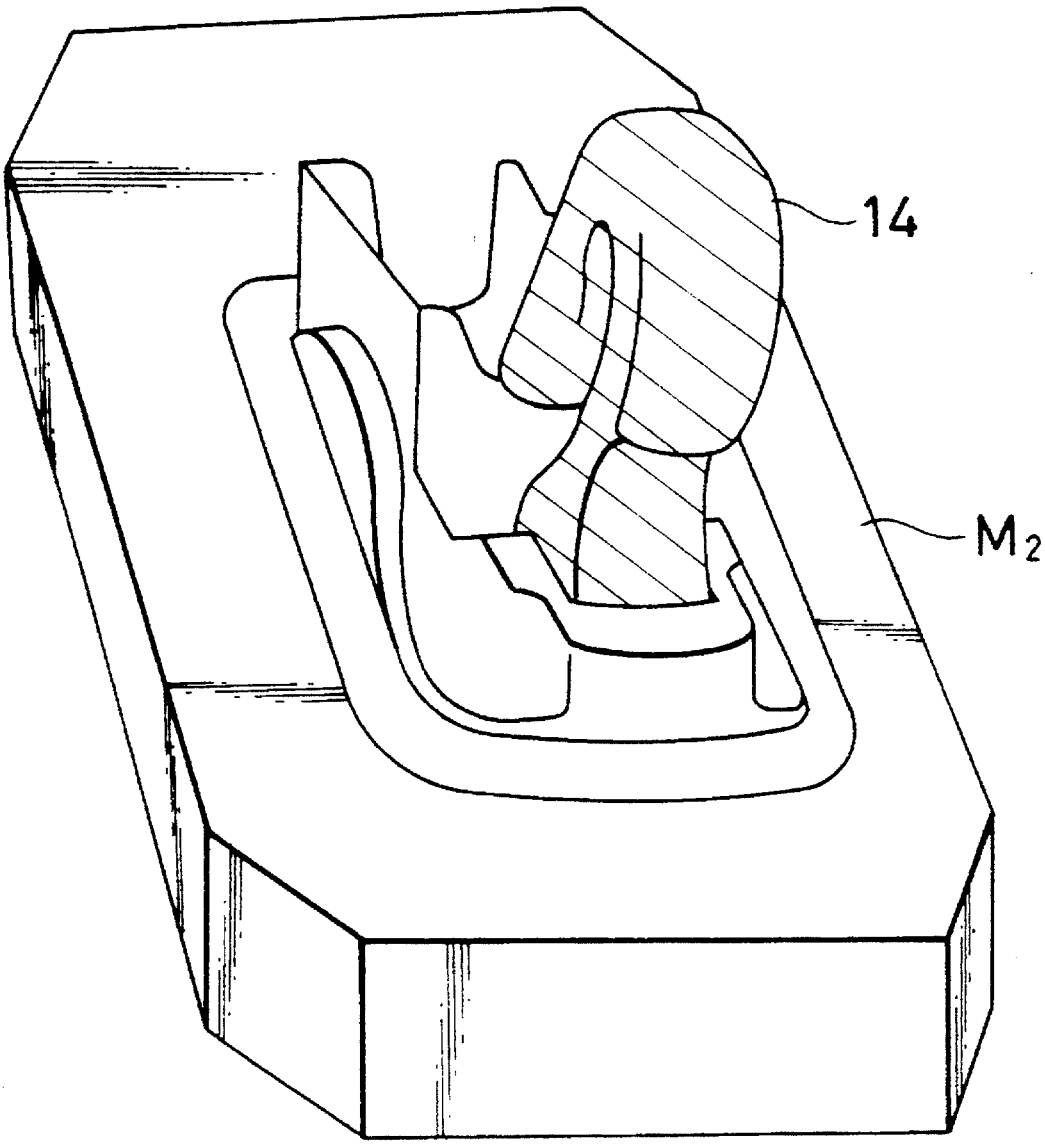
FIG. 10 is a perspective view of a mold used in the casting method of the present invention, with a trap placed on a bottom mold part.

The placement of the trap portion 14 in the mold cavity may be done simply by allowing the trap portion 14 to rest on the bottom mold part M2. FIG. 10 shows such a trap portion 14 (hatched) resting on the bottom mold part M2.

Figure 11:
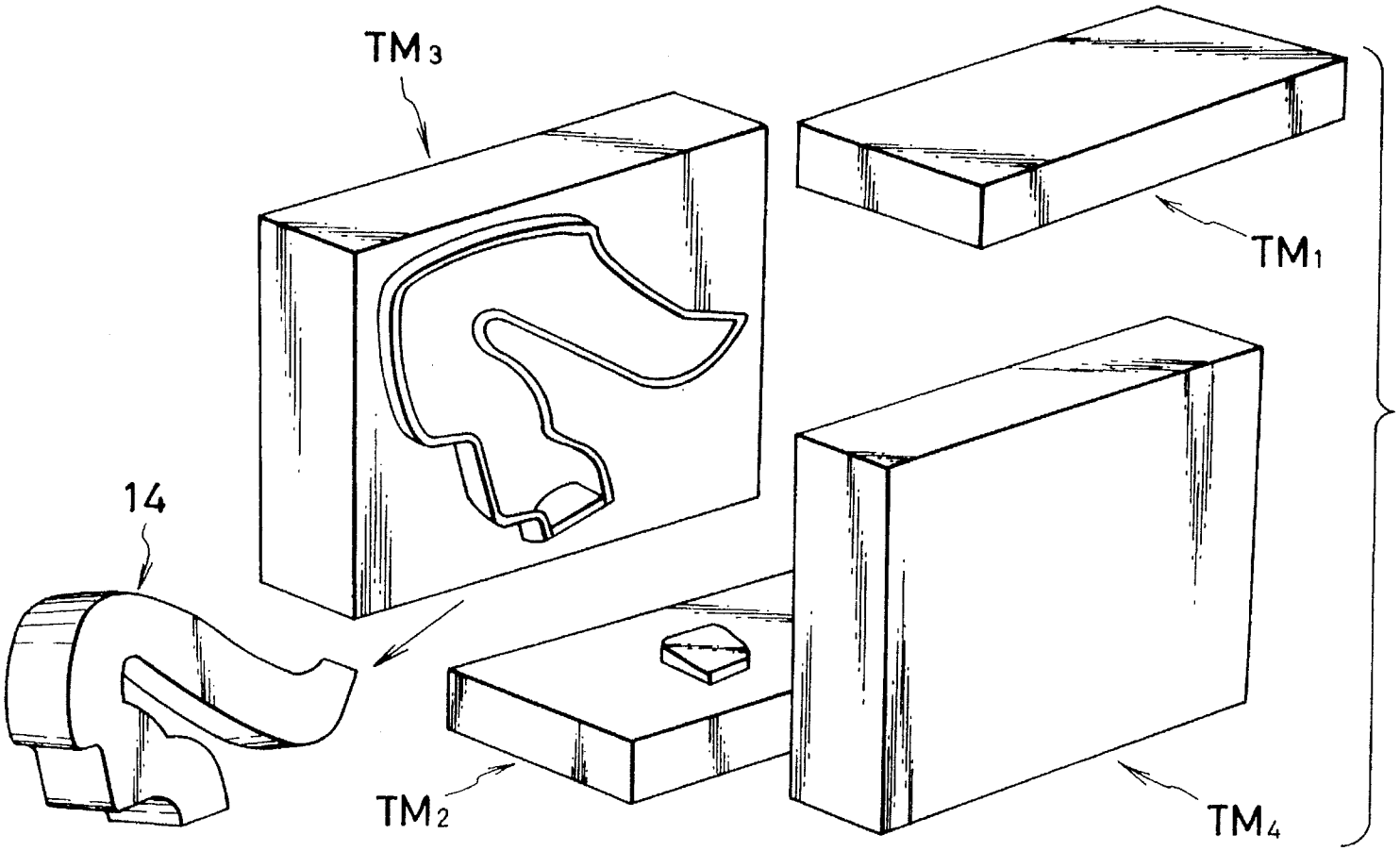
FIG. 11 is an exploded perspective view of a mold used in the present invention for casting a trap.

FIG. 11 illustrates a method for forming the trap 14. The trap can be formed by slip draining casting method by using a composite mold composed of mold parts TM1 to TM4.

A description will now be given of the result of the production conducted by using the method of the present invention.

The main part was formed from a slip which is vitreous china containing 60 wt % of pottery stone, 20 wt % of feldspar and 20 wt % of clay, as in the case of the known method, while the slip used as the material of the trap was prepared by adding, to the same slip as that for the main part, 0.3 wt % (dry weight basis) of sodium carboxymethyl cellulose. Both the main part and the trap were cast under atmospheric pressure in plaster molds. The trap exhibited water content of 26% when separated from the plaster mold, so that it was dried to attain a reduced water content of 22% when placed on the bottom mold part. Subsequently, the slip for forming the main part was supplied into the composite mold to form a deposit, followed by slip draining and hardening. The article thus formed by casting was separated from the mold and was dried and glaze was applied to the article. Then, firing was conducted to finalize the sanitary ware.

It was confirmed that the method of the present invention provides 20% improvement in the production efficiency as compared with the conventional method. Furthermore, the method of the invention did not cause any failure due to inferior bonding of the trap, which should be contrasted to the conventional method in which about 0.9% of the products were rejected for the reasons of defective bonding of the trap. The trap which is separately formed in the method of the invention may be applied to different models of the sanitary wares. In other words, a common design of trap can be used for a plurality of different models of the products.

Figure 12:
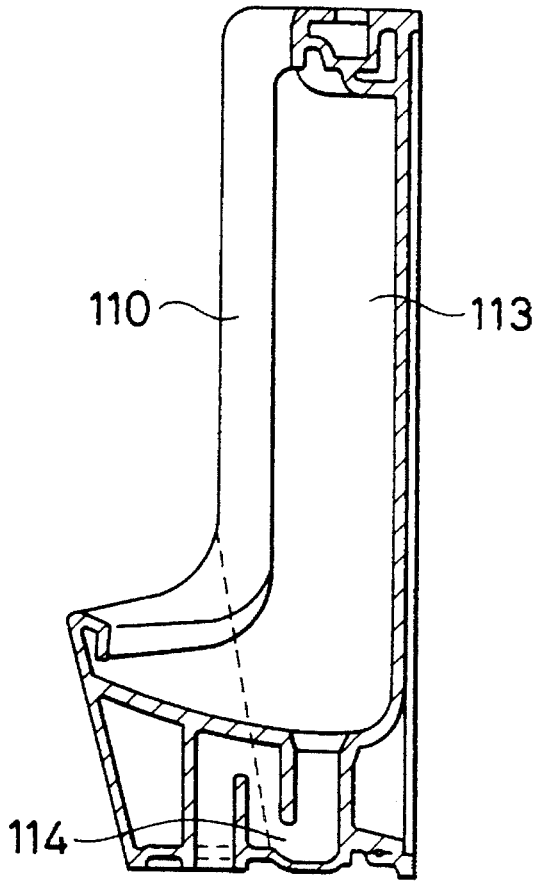
FIG. 12 is a vertical sectional view of a water flushing urinal stall.
Figure 13:
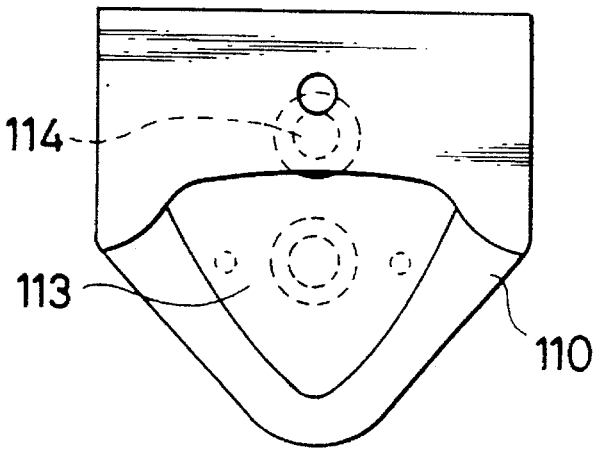
FIG. 13 is a plan view of the water flushing urinal stall.

FIGS. 12 and 13 are a vertical sectional view and a plan view of a water flushing urinal stall. This stall has a rim portion 110, a bowl portion 113 and a trap 114 as is the case of the water flushing toilet bowl described before.

Figure 14:
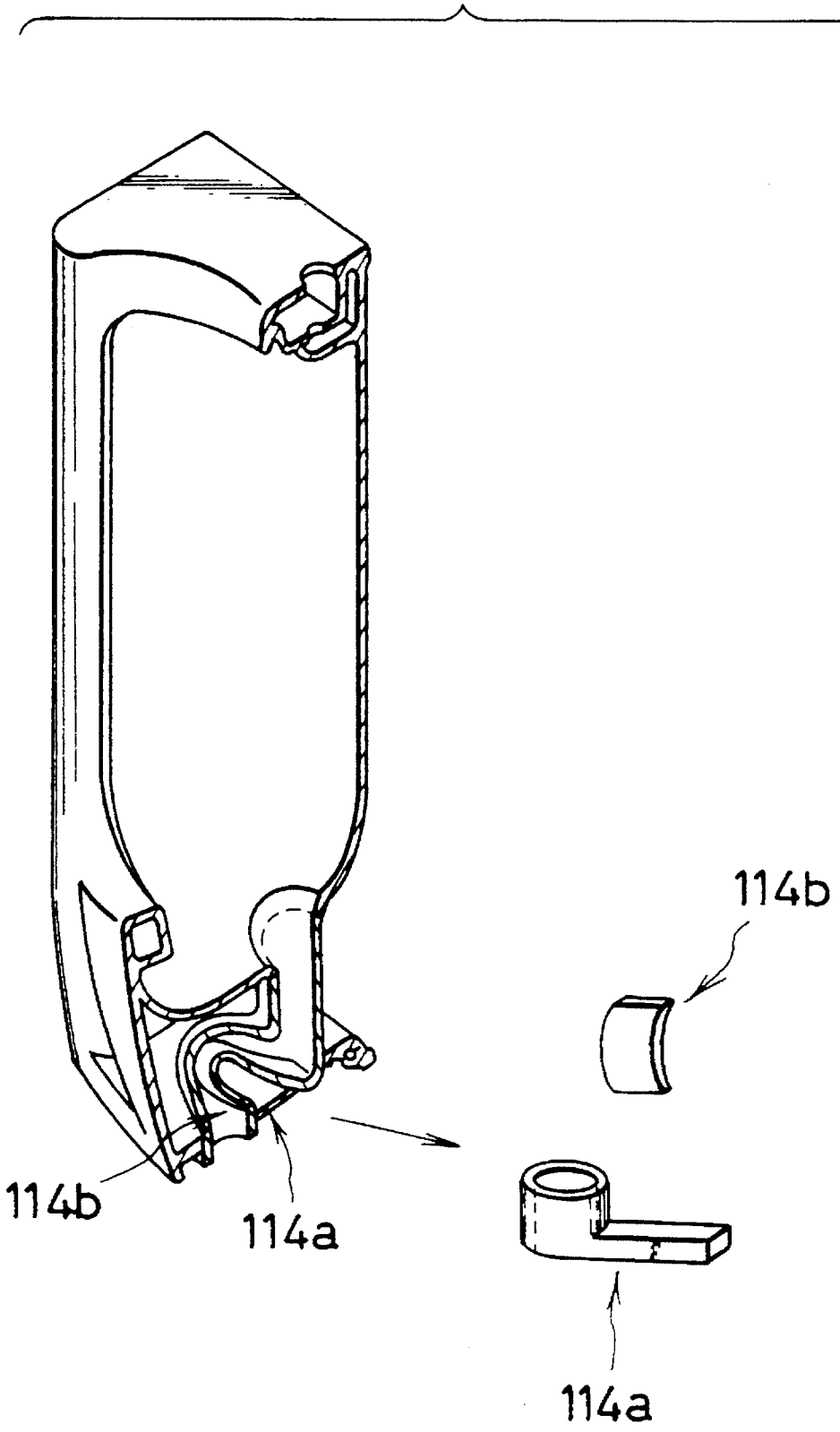
FIG. 14 is a sectional perspective view of a water flushing urinal stall produced by a conventional casting method.

Referring to FIG. 14 illustrative of a conventional method for forming this type of product, numerals 114*a*, 114*b* denote green ceramic bodies which were formed separately and which are to be bonded to the main part of the sanitary ware by a bonding slurry. Thus, the wall of the trap has a portion which is formed integrally with the main part and a portion which is formed separately and which is to be bonded to the main part. The portion (not shown) which is to be formed integrally with the main part is molded by using a split mold assembled on the bottom mold part (not shown).

Figure 15:
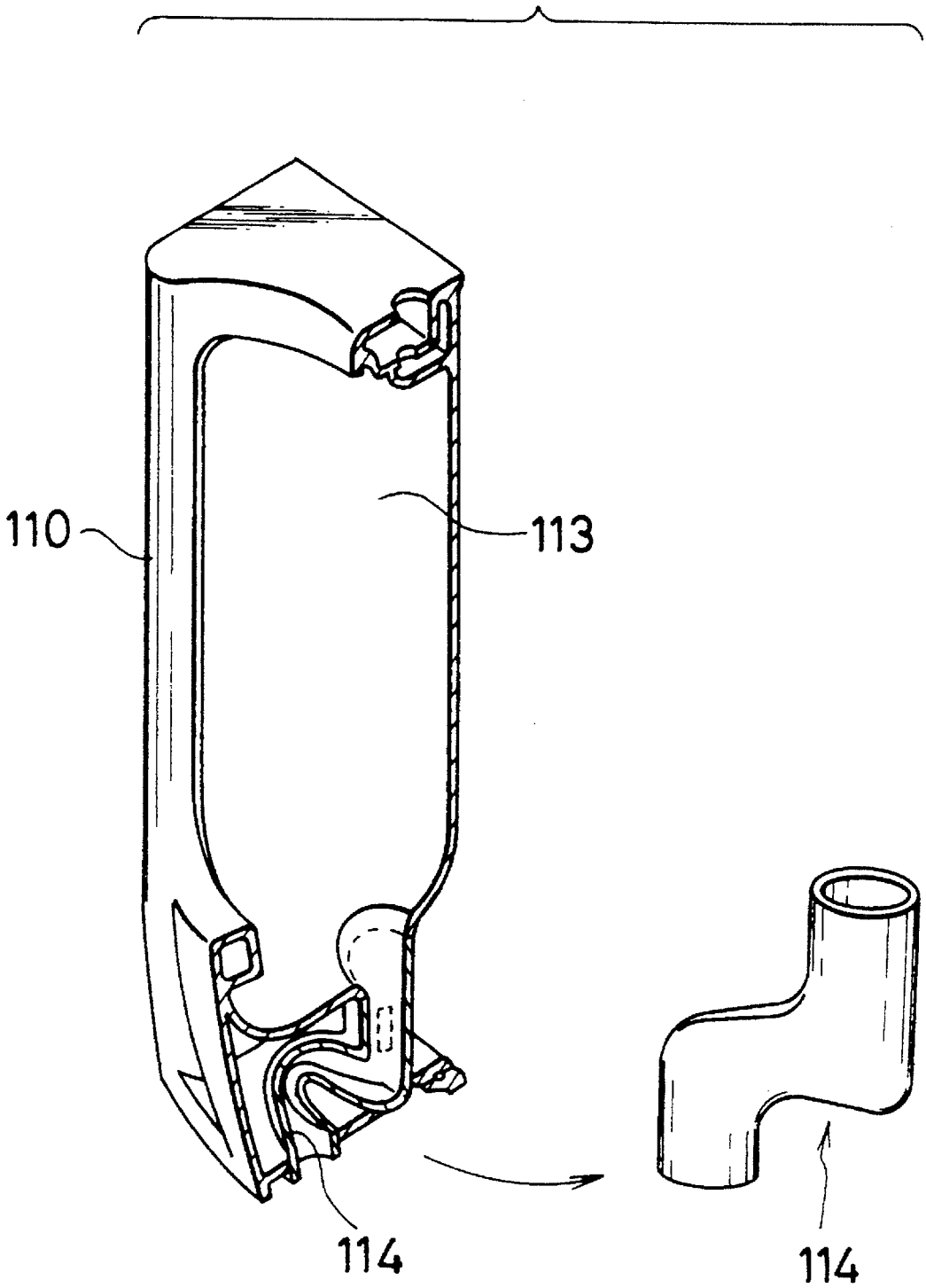
FIG. 15 is a sectional perspective view of a water flushing urinal stall produced by the casting method of the present invention.

Referring now to FIG. 15 which illustrates the method in accordance with the present invention, a separately formed trap 114 is placed on a bottom mold part (not shown), and a core mold and side mold parts are assembled to form a mold cavity which is then charged with the slip for forming the main part, whereby the trap is integrated with the main part of the sanitary ware. It will be understood that the method of the invention does not necessitate any split mold which is essentially required in the known method for forming the trap.

A description will not be given of the result of the production conducted by using the method of the present invention.

The main part and the trap were formed from a common slip which is vitreous china containing 60 wt % of pottery stone, 20 wt % of feldspar and 20 wt % of clay, as in the case of the known method. The main part and the trap were cast under pressures of 10 kgf/cm$^2$ and 40 kgf/cm$^2$, respectively. The trap exhibited water content of 21.5% when separated from the mold and was placed on the bottom mold part without being subjected to drying. Subsequently, the slip for forming the main part was supplied into the composite mold to form deposit, followed by slip draining and hardening. The article thus formed by casting was separated from the mold and was dried and glaze was applied to the article. Then, firing was conducted to finalize the sanitary ware.

It was confirmed that the method of the present invention provides 10% improvement in the production efficiency as compared with the conventional method. Furthermore, the method of the invention did not cause any failure due to inferior bonding of the trap, which should be contrasted to the conventional method in which about 0.6% of the products were rejected for the reasons of defective bonding of the trap. The trap which is separately formed in the method of the invention may be applied to different models of the sanitary wares. In other words, a common design of trap can be used for a plurality of different models of the products.

What is claimed is:

1. A method of casting a ceramic article, comprising the steps of:

preparing a porous casting mold defining a mold cavity;

forming separately a green ceramic body;

placing said green ceramic body in said mold cavity; and supplying a slip into said mold cavity to form a deposit thereof on an inner surface of said mold, thereby forming a ceramic article composed of said green ceramic body and said deposit of said slip integrated with each other, said green ceramic body and said slip being substantially the same in composition, and wherein a water content of said green ceramic body placed in said mold cavity is greater than a critical moisture content of said green ceramic body but smaller than a water content of said deposit formed from said slip, as measured at a time of completion of said deposition so as to prevent said green ceramic body from swelling.

2. A method according to claim 1 wherein said green ceramic body is formed by slip casting under a pressure which is greater than a casting pressure of said slip supplied into said porous mold.

3. A method according to claim 1 wherein said green ceramic body has a green raw material particle size smaller than a particle size of said slip.

4. A method according to claim 1 wherein a composition of said green ceramic body contains a binder.

5. A method of casting a ceramic article, comprising the steps of:

preparing a porous casting mold defining a mold cavity;

forming separately a green ceramic body;

placing said green ceramic body in said mold cavity; and supplying a slip into said mold cavity to form a deposit thereof on an inner surface of said mold, thereby forming a ceramic article composed of said green ceramic body and said deposit of said slip integrated with each other, said green ceramic body and said slip being substantially the same in composition, and wherein a water content of said green ceramic body approximates a water content of said slip so as to prevent said green ceramic body from swelling.

6. A method according to claim 5 wherein a composition of said green ceramic body contains a binder.

* * * * *